US010128589B2

(12) United States Patent
Yamaguchi

(10) Patent No.: US 10,128,589 B2
(45) Date of Patent: Nov. 13, 2018

(54) ELECTRICAL CONNECTOR FOR FLAT CONDUCTOR

(71) Applicant: Hirose Electric Co., Ltd., Tokyo (JP)

(72) Inventor: Shohei Yamaguchi, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/657,199

(22) Filed: Jul. 23, 2017

(65) Prior Publication Data

US 2018/0034174 A1 Feb. 1, 2018

(30) Foreign Application Priority Data

Aug. 1, 2016 (JP) ..... 2016151399

(51) Int. Cl.

| | |
|---|---|
| ***H01R 13/15*** | (2006.01) |
| ***H01R 13/62*** | (2006.01) |
| ***H01R 12/70*** | (2011.01) |
| ***H01R 12/73*** | (2011.01) |
| ***H01R 12/72*** | (2011.01) |
| ***H01R 13/627*** | (2006.01) |

(52) U.S. Cl.

CPC ..... *H01R 12/7005* (2013.01); *H01R 12/721* (2013.01); *H01R 12/732* (2013.01); *H01R 13/6273* (2013.01)

(58) Field of Classification Search

CPC ..... H01R 12/79; H01R 12/87; H01R 12/88; H01R 13/193; H01R 12/7005

USPC ..... 439/260, 261, 495

See application file for complete search history.

(56) References Cited

U.S. PATENT DOCUMENTS

| | | | | |
|---|---|---|---|---|
| 6,471,541 | B2 * | 10/2002 | Kunishi | H01R 12/79 439/492 |
| 6,851,968 | B2 * | 2/2005 | Tsunematsu | H01R 12/79 439/495 |
| 7,402,088 | B2 * | 7/2008 | Hsu | H01R 13/245 439/495 |
| 7,845,973 | B2 * | 12/2010 | Iida | H01R 12/88 439/495 |
| 7,909,630 | B2 * | 3/2011 | Yamada | H01R 12/88 439/260 |

(Continued)

FOREIGN PATENT DOCUMENTS

| | | |
|---|---|---|
| JP | 4993788 B2 | 8/2012 |
| JP | 5203046 B2 | 6/2013 |

*Primary Examiner* — Hae Moon Hyeon

(74) *Attorney, Agent, or Firm* — Procopio, Cory, Hargreaves & Savitch LLP

(57) ABSTRACT

A terminal, wherein the lower and upper arms have a plurality of integral lower flexible arms and integral upper flexible arms respectively, which include at least a first lower and upper flexible arm and a second lower and upper flexible arm that are elastically displaceable independently of each other, the lower striking portions each have a first and second lower striking portion formed on a first and second lower flexible arm respectively, the second lower striking portion at a position that is offset in the longitudinal direction with respect to the first lower striking portion, and the upper striking portions each have a first and second upper striking portion formed on a first and second upper flexible arm respectively, the second upper striking portion at a position that is offset in the longitudinal direction with respect to the first upper striking portion.

4 Claims, 4 Drawing Sheets

(56) References Cited

U.S. PATENT DOCUMENTS

| | | | | |
|---|---|---|---|---|
| 8,337,226 | B2 * | 12/2012 | Yokoo | H01R 12/79 439/260 |
| 8,540,528 | B2 * | 9/2013 | Wada | H01R 12/88 439/329 |
| 2009/0298315 | A1 * | 12/2009 | Iida | H01R 12/79 439/259 |

* cited by examiner

ELECTRICAL CONNECTOR FOR FLAT CONDUCTOR

CROSS REFERENCE TO RELATED APPLICATIONS

This Paris Convention Patent Application claims benefit under 35 U.S.C. § 119 and claims priority to Japanese Patent Application No. JP 2016-151399, filed on Aug. 1, 2016, titled "ELECTRICAL CONNECTOR FOR FLAT CONDUCTOR", the content of which is incorporated herein in its entirety by reference for all purposes.

BACKGROUND

Technical Field

The present invention relates to an electrical connector for a flat conductor, which is disposed on the mounting face of a circuit board, and to which a flat conductor is connected.

Background Art

Known connectors of this type are disclosed in Patent Document 1 and Patent Document 2.

With the connector in Patent Document 1, the terminals each have one lower arm (first piece) and one upper arm (second piece) that clamp a flat conductor in between them, two contact portions protrude from the lower arm, and two pressing portions protrude from the upper arm. The contact portions and the pressing portions are opposite each other in the up and down direction. In Patent Document 1, when a flat conductor is inserted between the lower arm and the upper arm, the upper arm is elastically bent and displaced by a pressurizing means (manipulation portion), and the upper face of the flat conductor is pressed by the two pressing portions provided to the upper arm, which raises the contact pressure between the flat conductor and the two contact portions on the lower arm.

With the connector in Patent Document 2, the terminals each have two lower arms that extend from the terminal area supported by the bottom wall of the housing and that are elastically displaceable independently of each other, and each of the lower arms has a protruding contact portion. The contact portions of the two lower arms are located at mutually different positions in the longitudinal direction (the direction in which the flat conductor is inserted). Meanwhile, the upper arms of the terminals are each configured to rotationally support the pressurizing member in a first mode, and a portion (the pressurizing portion) of the pressurizing member presses on the flat conductor between the two contact portions in the longitudinal direction during rotation of the pressurizing member. In Patent Document 2, in a second mode, one pressing portion is provided to a flexible upper arm of a terminal, and the flat conductor is pressed by this pressing portion. Furthermore, Patent Document 2 also discloses a third mode in which the positions of the upper arm and the lower arm of the second mode are switched in the up and down direction.

PRIOR ART DOCUMENTS

Patent Document

Patent Document 1: Japanese Patent No. 5,203,046
Patent Document 2: Japanese Patent No. 4,993,788

SUMMARY

Problems to be Solved by the Invention

However, with the connector of Patent Document 1, both the lower arm having two contact portions and the upper arm having two pressing portions are formed as a single arm unit. Therefore, if one of the two contact portions is displaced, for example, the other is also displaced accordingly. As a result, in a state in which the flat conductor is connected to the connector, there may be so-called tilt, in which the flat conductor is undesirably lifted up or inclined under an external force, in which case contact may worsen at both contact portions simultaneously, which adversely affects contact reliability. The same applies to the two pressing portions.

Meanwhile, with the connector of Patent Document 2, since the contact portions are respectively provided to the two lower arms which are independently elastically displaceable, even if the contact state should deteriorate at one contact portion, the other contact portion will still have a good contact state regardless of this. However, it is the pressurizing portion, which is a part of the pressurizing member in the first mode, that presses the flat conductor against the two contact portions, and in the second and the third modes, there is just one pressing portion, which in both cases is located between the two contact portions in the longitudinal direction. Therefore, when the flat conductor becomes tilted as mentioned above, the force thereof has to be borne by the pressurizing portion or pressing portion at just one location, so there is a higher load on the pressurizing portion or the pressing portion, making it harder to maintain the contact pressure on the easily deformed contact portion. Also, since the pressurizing portion or the pressing portion is positioned between the two contact portions in the longitudinal direction and is offset from the contact portions, it is harder for the flat conductor to be firmly clamped between the pressurizing portion or the pressing portion and the contact portions. Thus, the reliability of contact is reduced at the contact portions when the flat conductor is tilted.

The present invention was conceived in light of the above situation, and it is an object thereof to provide an electrical connector for a flat conductor, with which there is no deformation of a pressing portion due to an excessive load on the pressing portion, and contact reliability at the contact portions will not be decreased.

Means for Solving the Problems

It is an object of the present invention to provide an electrical connector for a flat conductor, with which excessive load on the striking portions of the terminals is prevented, and the contact reliability with the flat conductor is enhanced.

The electrical connector for a flat conductor pertaining to the present invention comprises a housing formed with a receptacle into which a connecting portion provided on the front end side of a flat conductor is inserted forward, a plurality of terminals made of sheet metal and arranged on and supported by the housing at a right angle to the flat plane of the housing, and a pressurizing member that is movably supported by the housing or by a member attached to the housing and that increases the contact pressure between the flat conductor and the terminals.

With this electrical connector for a flat conductor of the present invention, at least some of the plurality of terminals each have a lower arm that is supported by the bottom wall of the housing and is formed with a lower striking portion that strikes the lower face of the flat conductor, and an upper arm that is linked via a linking portion to the lower arm, receives force from the pressurizing member, presses on the upper face of the flat conductor, and is formed with an upper striking portion that increases the contact pressure between the flat conductor and the lower striking portion. The lower arms each have a plurality of integral lower flexible arms including at least a first lower flexible arm and a second lower flexible arm that are elastically displaceable independently of each other. The lower striking portions each have a first lower striking portion formed on a first lower flexible arm and a second lower striking portion that is formed on a second lower arm at a position that is offset in the longitudinal direction with respect to the first lower striking portion. The upper arms each have a plurality of integral upper flexible arms including at least a first upper flexible arm and a second upper flexible arm that are elastically displaceable independently of each other. The upper striking portions each have a first upper striking portion formed on a first upper flexible arm and a second upper striking portion that is formed on a second upper arm at a position that is offset in the longitudinal direction with respect to the first upper striking portion.

With the present invention configured as above, the upper arm and the lower arm independently have a plurality of upper flexible arms and lower flexible arms, respectively, and upper striking portions and lower striking portions are respectively formed on the upper flexible arms and the lower flexible arms, so the upper flexible arms and lower flexible arms can be elastically displaced independently, and the plurality of striking portions strike the upper and lower faces of the flat conductor, and more specifically, a plurality of the upper striking portions strike the upper face of the flat conductor without affecting each other, and a plurality of the lower striking portions strike the lower face without affecting each other, so a good state of contact with the flat conductor can be maintained. In addition, the force received from the flat conductor is dispersed over the plurality of striking portions, and as a result the load at each striking portion does not become excessive.

In the present invention, the lower striking portions can be provided at positions where the first lower striking portions are opposite the first upper striking portions of the upper striking portions in the up and down direction, and the second lower striking portions are opposite the second upper striking portions in the up and down direction. The result of this is that the plurality of the upper striking portions and the lower striking portions are opposite each other in the up and down direction, and the flat conductor is securely clamped at a plurality of places, so contact reliability between the terminals and the flat conductor can be further improved.

In the present invention, the lower flexible arms and/or the upper flexible arms of the terminals can be in a two-ply structure obtained by bending a single sheet of metal. The result of this is that the terminals are formed in a two-ply structure at the lower flexible arms and/or the upper flexible arms, which ensures good contact reliability while lowering the height and reducing the size in the longitudinal direction.

Effects of the Invention

As discussed above, with the present invention, in order for a flat conductor to be clamped on both sides from above and below, the lower arms and upper arms of the terminals each have a plurality of lower flexible arms and upper flexible arms that are elastically displaceable independently of each other, the plurality of lower flexible arms each have a lower striking portion and the plurality of upper flexible arms each have an upper striking portion, and the plurality of lower striking portions strike the lower face of the flat conductor while the plurality of upper striking portions strike the upper face, so when a flat conductor has been connected to the connector, if the flat conductor is subjected to tilting, a good state of contact is reliably maintained with some of the plurality of the lower striking portions and some of the plurality of the upper striking portions being displaced independently on both sides of the flat conductor, and the force from the flat conductor is dispersed over the plurality of lower striking portions and upper striking portions, so neither the lower striking portions nor the upper striking portions will be subjected to an excessive force, and as a result contact reliability can be increased between the terminals and the flat conductor.

DETAILED DESCRIPTION

Figure 1:
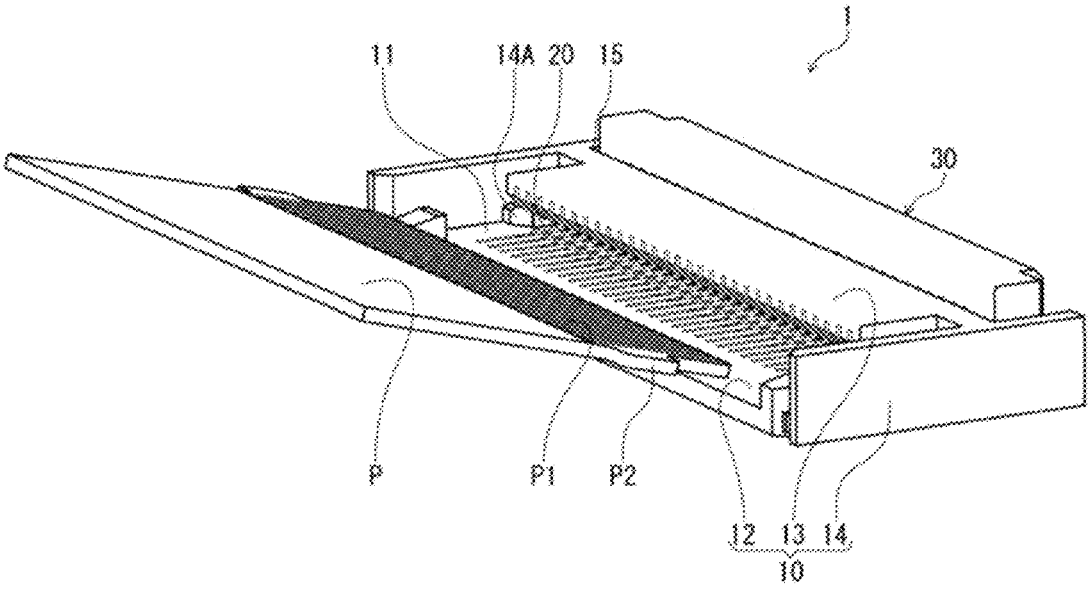
FIG. 1 illustrates an oblique view of the overall appearance of the connector in an embodiment of the present invention along with a flat conductor just before being connected.

The connector 1 in the embodiment shown in FIG. 1 has a housing 10 that accepts the front end portion of a flat conductor P in which a circuit P1 has been formed on this front end portion of the flat conductor P, terminals 20 that are supported by the housing 10 and are in contact with and connected to the circuit P1 of the flat conductor P, and a pressurizing member 30 for raising the contact pressure between the terminals 20 and the circuit P1 of the flat conductor P. The side edges of the flat conductor P are provided with latching tabs P2 that latch onto latching protrusions provided on the connector side and prevent the flat conductor P from coming loose.

The housing 10 is made of an electrically insulating material, and has a relatively flat, rectangular outer shape. A receptacle 11 for receiving the front end portion of the flat conductor P faces rearward, and is formed between a bottom wall 12 and an upper wall 13 so as to open upward at its rear end portion as well. A plurality of terminals 20 are arranged in the receptacle 11, with the width direction of the receptacle 11 being the terminal arrangement direction. The housing 10 has side walls 14 that restrict the position of the front end portion of the flat conductor P in the width direction when it is inserted into the receptacle 11, and the bottom wall 12 and the upper wall 13 are linked at the side end positions of these side walls 14. Latching protrusions 14A that latch with the above-mentioned latching tabs P2 of the flat conductor P are provided on their inner faces.

The pressurizing member 30 for supporting the contact pressure of the terminals 20 against the flat conductor P inserted into the receptacle 11 is located between the front end portions of the side walls 14 inside a front opening 15 formed on the front end side of the housing 10, and is rotatably supported by the terminals 20.

The internal structure forming the receptacle 11 of the housing 10, the terminals 20, and the pressurizing member 30 will now be described through reference to FIGS. 2 and 3.

Figure 2:
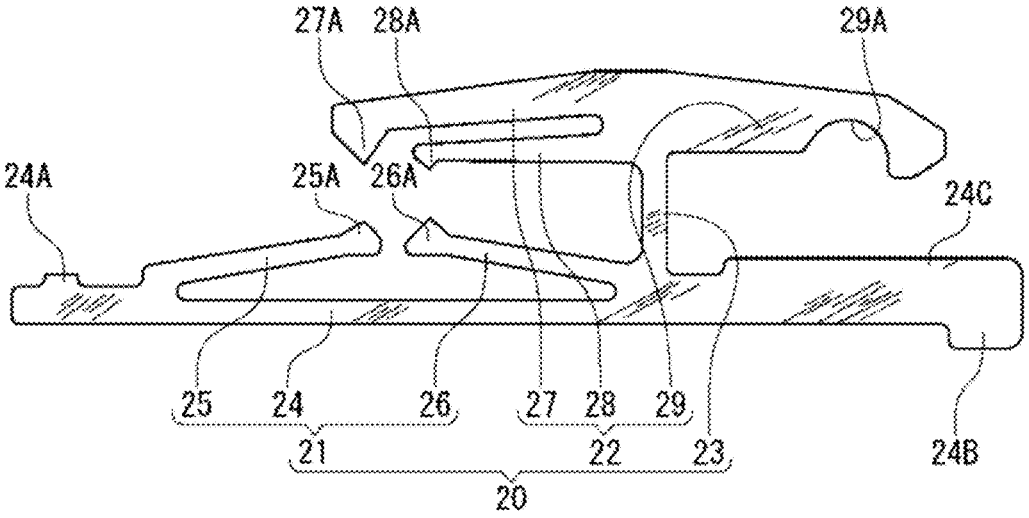
FIG. 2 illustrates a front view of a terminal used in the connector in FIG. 1.

The terminals 20 are made of sheet metal, and in the embodiment shown in FIG. 2, the plane of the sheet metal is maintained parallel to the viewing plane. The terminal 20 has a lower arm 21 and an upper arm 22 which are long in the lateral direction, and a linking portion 23 that links the arms at an intermediate position in their lengthwise direction (longitudinal direction).

The lower arms 21 each have a fixed arm 24 that is fixed to and supported by the bottom wall 12 in surface contact along the bottom wall 12 of the housing 10 (discussed below) (see also FIG. 3A), a first lower flexible arm 25 that extends forward with an upward gradient from the fixed arm 24 at a position near the rear end of the fixed arm 24 (the left end in FIG. 2), and a second lower flexible arm 26 that extends rearward from the fixed arms 24 so as to approach the first lower flexible arms 25 at a position of the linking portion 23 ahead of the first lower flexible arms 25.

Figure 3A:
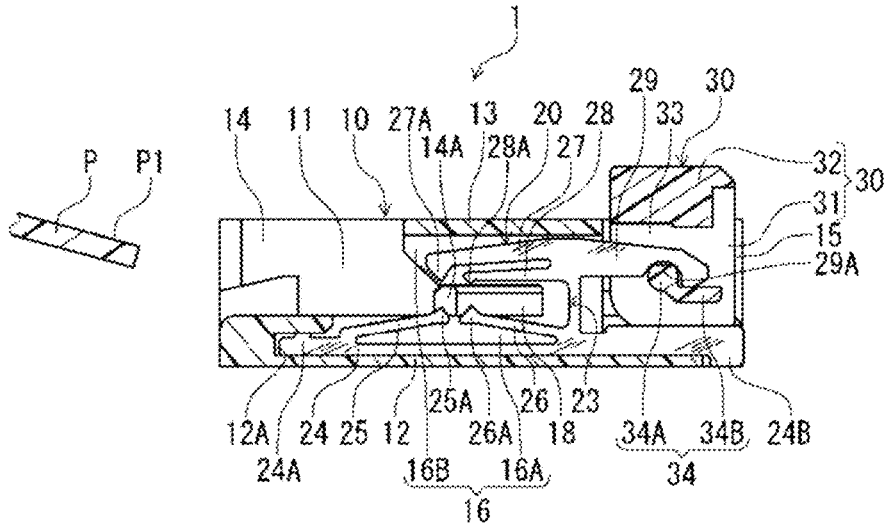
FIGS. 3A to 3C illustrate cross sections at the terminal position of the connector in FIG. 1, with FIG. 3A showing the state just before connection of the flat conductor, FIG. 3B the state after the flat conductor has been inserted into the connector, and FIG. 3C the connected state of the flat conductor and the terminal.

As seen in FIG. 3A, the fixed arm 24 has at its rear end a rear fixed protrusion 24A, which is fixed by press-fitting rearward toward a rear fixing groove 12A formed at the rear end of the bottom wall 12 of the housing 10 and which protrudes to the upper edge of the fixed arm 24. The fixed arm 24 has at its front end a connecting portion 24B that protrudes downward from the front end lower edge of the bottom wall 12 of the housing 10 and is located at the same level with or slightly below the lower face of the bottom wall 12. The connecting portion 24B is soldered onto a circuit board, to the corresponding circuit portion of the circuit board.

A first lower striking portion 25A in the form of a protrusion that faces upward is formed at the front end of the first lower flexible arm 25 extending forward from near the rear end of the fixed arm 24, and a second lower striking portion 26A in the form of a protrusion that faces upward is formed at the rear end of the second lower flexible arm 26 extending rearward from the position of the linking portion 23. The first lower striking portion 25A and the second lower striking portion 26A are close together in the longitudinal direction, but are not touching, and in this longitudinal direction, they are located within the range of the circuit P1 of the flat conductor P inserted up to the normal position in the receptacle 11. When the circuit P1 of the flat conductor P is formed on the lower face of the flat conductor P, the first lower striking portion 25A and the second lower striking portion 26A function as the contact portions of the terminal 20, and when the circuit P1 is formed only on the upper face of the flat conductor P, they function as support portions that support the flat conductor from below. The first lower flexible arm 25 and the second lower flexible arm 26 are both capable of elastic bending displacement in the up and down direction, and the first lower striking portion 25A and the second lower striking portion 26A produce a striking force based on this elastic bending displacement between themselves and the flat conductor P.

The upper arm 22 positioned above the lower arm 21 and linked to the lower arm 21 by the linking portion 23 has a first upper flexible arm 27 and a second upper flexible arm 28 constituting two arms extending rearward from the position of the linking portion 23, and a pressure receiving arm 29 extending forward from the position of the linking portion 23.

The first upper flexible arm 27 and the second upper flexible arm 28 extend rearward and substantially parallel in a state in which the first upper flexible arm 27 is located above the second upper flexible arm 28, a first upper striking portion 27A in the form of a protrusion that faces downward is provided to the rear end of the first upper flexible arm 27, and a second upper striking portion 28A in the form of a protrusion that faces downward is provided to the rear end of the second upper flexible arm 28. The first upper striking portion 27A is located in substantially the same position as the first lower striking portion 25A of the first lower flexible arm 25 in the longitudinal direction and opposite the first lower striking portion 25A in the up and down direction with a gap in the up and down direction so that the flat conductor P can be inserted, while the second upper striking portion 28A is located in substantially the same position as the second lower striking portion 26A of the second lower flexible arm 26 in the longitudinal direction and is opposite the second lower striking portion 26A in the up and down direction. Since the first upper flexible arm 27 and the second upper flexible arm 28 both extend rearward from the position of the linking portion 23, and the rear ends where the first upper striking portion 27A and the second upper striking portion 28A are located are positioned corresponding to the first lower striking portion 25A and the second lower striking portion 26A in the longitudinal direction, the length of the receptacle 22 facing rearward from the linking portion 23 is shorter than the lower arm 21.

The pressure receiving arm 29 extending forward from the linking portion 23 is relatively wide (in the up and down direction), and a pressure receiving portion 29A that is curved in a concave shape is formed at the lower edge thereof on the front end side. This pressure receiving portion 29A receives upward force from the cam of the pressurizing member 30 (discussed below). Because it is wide as mentioned above, the pressure receiving arm 29 is rigid, but because the linking portion 23 is comparatively narrow (in the left and right direction), when upward force is received from the cam by the pressure receiving portion 29A, the pressure receiving arm 29 itself does not bend, but the linking portion 23 undergoes elastic bending displacement in the direction of rotation at the portion linked to the pressure receiving arm 29, and as a result the pressure receiving arm 29 inclines upward, and the above-mentioned two arms, namely, the first upper flexible arm 27 and the second upper flexible arm 28, incline downward with this linking position serving as the fulcrum. Since the first upper flexible arm 27 and the second upper flexible arm 28 are thus inclined downward, the first upper striking portion 27A and the second upper striking portion 28A provided to their rear ends strike the flat conductor and press the flat conductor downward.

When the circuit P1 of the flat conductor P is formed on the lower face of the flat conductor P, the first upper striking portion 27A and the second upper striking portion 28A function as pressing portions that press the flat conductor P toward the first lower striking portion 25A and the second lower striking portion 26A constituting the contact portions of the terminal 20, and when the circuit P1 of the flat conductor P is formed only on the upper face of the flat conductor P or is also formed on the upper face in addition, they function as pressing portions and also function as contact portions. The first upper flexible arm 27 and the second upper flexible arm 28 are both capable of elastic bending displacement in the up and down direction, and the first upper striking portion 27A and the second upper striking portion 28A produce a striking force based on the above-mentioned elastic bending displacement between themselves and the flat conductor P.

The internal structure of the housing 10 that supports the terminals 20 as described above is as follows.

In the housing 10, a terminal holding groove 16 is formed between the bottom wall 12 and the upper wall 13. The terminal holding groove 16 has a lower groove 16A formed on the upper face of the bottom wall 12 and an upper groove 16B formed on the lower face of the upper wall 13, with the two grooves opposite each other. In FIG. 3, the grooves 16 are arranged at positions corresponding to the terminals 20 in a direction that is perpendicular to the viewing plane.

The housing 10 is such that the receptacle 11, an insertion portion 18 that extends forward from the receptacle 11 and is used for inserting and positioning the flat conductor P, and the front opening 15 all extend at a right angle to the viewing plane of FIG. 3 over the range between the two side walls 14. Therefore, the terminal holding groove 16 made up of the lower groove 16A and the upper groove 16B is penetrated by the insertion portion 18 between the lower groove 16A and the upper groove 16B.

The rear fixing grooves 12A, which are formed in the lower arms 21 of the terminals 20 at the rear end position and into which are press-fitted the rear fixed protrusions 24A, are formed opening forward in the bottom wall 12 of the housing 10. Also, the front end of the bottom wall 12 is notched so that the connecting portions 24B of the terminals 20 can stick out.

With this type of connector, the receptacle 11 is open not only to the rear, but also upward at the rear portion of the housing 10 in order to facilitate the work of inserting the flat conductor P into the receptacle 11. In other words, the bottom wall 12 of the housing 10 protrudes far to the rear of the upper wall 13. The rear fixing grooves 12A make use of the rear end portion of the bottom wall 12 that thus protrudes rearward, and are formed within the wall thickness thereof. The formation of these rear fixing grooves 12A makes it unnecessary to provide fixing portions for fixing the terminals inside the housing. Also, the upper face of the bottom wall 12 has the function of guiding the slide of the front end of the flat conductor P toward the first lower flexible arms 25 of the terminals 20 when the flat conductor P is inserted.

Also, the upper wall 13 of the housing 10 is notched so that the portion near the rear end will form the receptacle 11, and the portion near the front end will form the front opening 15.

The pressurizing member 30 disposed in the front opening 15 of the connector 1 is similar to the housing 10 in that it is made of an electrically insulating material, and is rotatably supported by the pressure receiving portions 29A formed on the upper arms 22 of the terminals 20. This pressurizing member 30 is able to rotate between the open position shown in FIGS. 3A and 3B, and the closed position shown in FIG. 3C. The pressurizing member 30 has a base portion 31 that is housed in the front opening 15 of the housing 10, and a manipulation portion 32 that protrudes upward from the front opening 15, in the open position in FIG. 3A.

In the base portion 31 are formed pressure receiving arm accepting grooves 33 that extend in a plane parallel to the viewing plane, so as to accept the pressure receiving arms 29 of the upper arms 22 of the terminals 20, at positions corresponding to the terminals 20 in the terminal arrangement direction, which is at a right angle to the viewing plane in FIG. 3A. A cam 34 is provided inside each pressure receiving arm accepting groove 33 so as to connect the opposing inner faces of the pressure receiving arm accepting grooves 33. These cams 34 each have a shaft 34A that is formed in a concave shape in a pressure receiving arm 29 and is located within a pressure receiving portion 29A, and an arm 34B that extends to the right from the pressure receiving portion 29A in FIG. 3A.

Figure 3B:
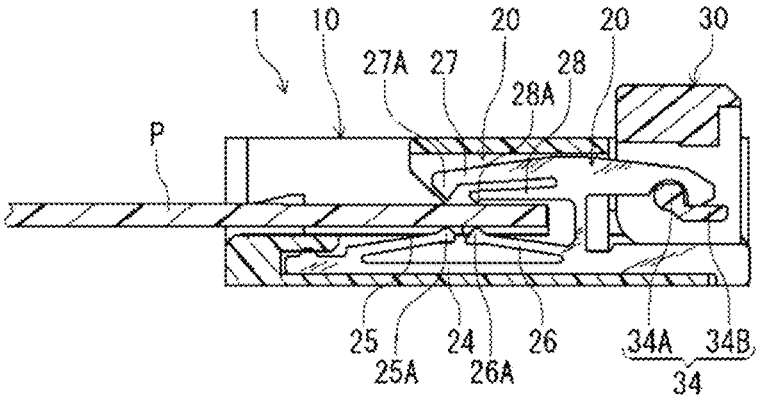
Figure 3C:
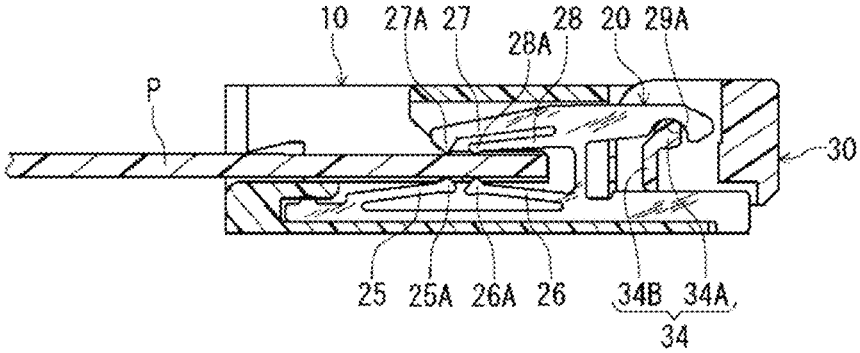

The arms 34B are such that when the pressurizing member 30 rotates around the shafts 34A within the pressure receiving portions 29A from the open position in FIG. 3A to the closed position in FIG. 3C, as seen in FIG. 3C, the distal ends (lower ends) of the arms 34B of the cams 34 of the pressurizing member 30 strike the front end upper edges 24C of the lower arms 21 of the terminals 20 and receive a repulsion force from the front end upper edges 24C, this force is transmitted through the shafts 34A to the pressure receiving portions 29A of the terminals 20, and the pressure receiving portions 29A are lifted upward.

The connector of this embodiment configured as above is used in the following manner.

The flat conductor P seen in FIG. 1 has the circuit P1 on its upper face side, and when the flat conductor P is used in the connector 1 as it is orientated, the first upper striking portions 27A and the second upper striking portions 28A formed on the two flexible arms, namely the first upper flexible arms 27 and the second upper flexible arms 28, provided to the upper arms 22 of the terminals 20 function as pressing portions that press the flat conductor P from above, and also function as contact portions that are in contact with and connected to the circuit P1 of the flat conductor P.

As shown in FIG. 3A, first the pressurizing member 30 is put in the open position where it rises upward, and the front end side of the flat conductor P where the circuit P1 is provided is positioned in a slightly inclined orientation directly rearward of the receptacle 11 of the connector 1.

Next, the flat conductor P is gradually put into a horizontal orientation while being inserted forward toward the receptacle 11 and, as seen in FIG. 3B, the front end potion of the flat conductor P passes through the space between the first lower striking portions 25A and the second lower striking portions 26A and the first upper striking portions 27A as well as the second upper striking portions 28A of the terminals 20 in the up and down direction, and the flat conductor P is moved forward until it strikes the innermost wall face of the insertion portion 18 of the housing 10. The front end portion of the flat conductor P here is guided toward the first lower flexible arms 25 of the terminals 20 at the rear end upper face of the bottom wall 12 where the rear fixing grooves 12A are located. When the front end portion of the flat conductor P strikes the innermost wall face of the insertion portion 18, the flat conductor P has been inserted up to its normal position. In this normal position, the latching tabs P2 of the flat conductor P are latched with the latching protrusions 14A of the housing 10, which prevents the flat conductor P from coming loose.

After this, the pressurizing member 30 is rotated from the open position in FIG. 3B to a closed position (horizontal state) as seen in FIG. 3C. When the pressurizing member 30 is rotated to the closed position, the arms 34B of the cams 34 of the pressurizing member 30 strike the front end upper edges 24C of the lower arms 21 of the terminals 20 and receive an upward repulsion force from the front end upper edges 24C, this force is transmitted through the shafts 34A of the cams 34 to the pressure receiving portions 29A formed on the upper arms 22 of the terminals 20, these upper arms 22 tilt so as to be lifted upward in front of the linking portions 23, with the linking portions 23 serving as the fulcrum, and the first upper flexible arms 27 and the second upper flexible arms 28 are tilted downward at the rear of the linking portions 23. As a result, the first upper flexible arms 27 and the second upper flexible arms 28 undergo elastic bending displacement independently of each other, while coming into contact with the circuit P1 of the flat conductor P at the first upper striking portions 27A and the second upper striking portions 28A, respectively, and pressing the flat conductor P downward.

Therefore, the first lower flexible arms 25 and the second lower flexible arms 26, which receive the downward pressing force via the flat conductor P at the first lower striking portions 25A and the second lower striking portions 26A, undergo elastic displacement independently of each other while supporting the flat conductor P from its lower face.

Thus, the first lower striking portions 25A are opposite the first upper striking portions 27A and the second lower striking portions 26A are opposite the second upper striking portions 28A in the up and down direction, independently of each other, and clamp the flat conductor P, and the first upper striking portions 27A and second upper striking portions 28A, or the first lower striking portions 25A and second lower striking portions 26A function as contact portions. Here, the first lower flexible arms 25 on which the first lower striking portions 25A are formed, the second lower flexible arms 26 on which the second lower striking portions 26A are formed, the first upper flexible arms 27 on which the first upper striking portions 27A are formed, and the second upper flexible arms 28 on which the second upper striking portions 28A are formed are capable of elastic bending displacement independently of each other, so they will be in a good contact state without affecting one another, the contact pressure is maintained at each, and contact reliability with the circuit P1 of the flat conductor P is improved. The same applies when the circuit P1 is provided on both sides of the flat conductor P.

Next, another embodiment of the present invention will be described through reference to FIG. 4.

Figure 4:
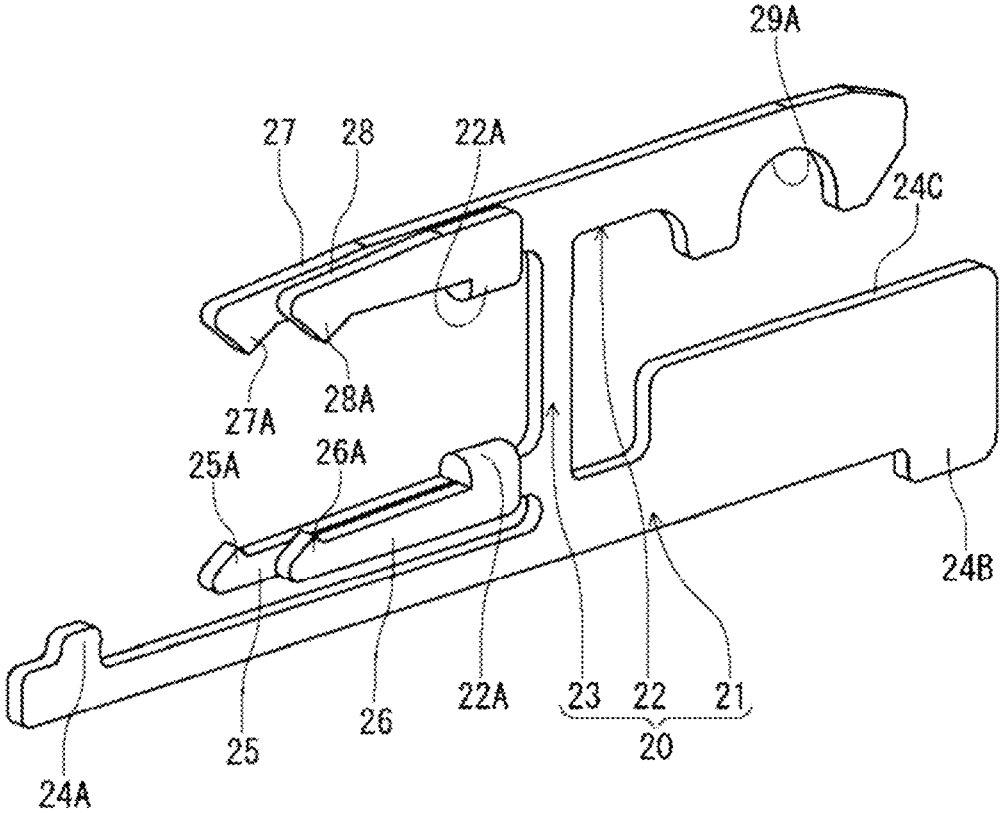
FIG. 4 illustrates an oblique view of another embodiment of the terminals of the connector in FIG. 1.

With the previous embodiment in FIGS. 1 to 3, the terminals 20 had the plane of the metal sheets maintained, and the first upper flexible arms, the second upper flexible arms, the first lower flexible arms, and the second lower flexible arms were all located in the same plane, but with the embodiment in FIG. 4, the second upper flexible arm 28 is bent at its base by an upper bending portion 22B with respect to the first upper flexible arm 27 and is in a two-ply structure with the first upper flexible arm 27, while the second lower flexible arm 26 is bent at its base by a lower bending portion 22A with respect to the first lower flexible arm 25 and is in a two-ply structure with the first lower flexible arm 25. This is different from the previous embodiment in which the first lower flexible arm 25 and the second lower flexible arm 26 extended in the same direction and were substantially in vertical symmetry with respect to the first upper flexible arm 27 and the second upper flexible arm, and the first lower flexible arm and the second lower flexible arm extended in mutually opposite directions. This embodiment is the same as the previous embodiment in that the first upper striking portions 27A and the second upper striking portions 28A are in respectively different positions from those of the first lower striking portions 25A and the second lower striking portions 26A in the longitudinal direction, and in that the first upper striking portions 27A and the first lower striking portions 25A are respectively opposite the second upper striking portions 28A and the second lower striking portions 26A in the up and down direction.

With this embodiment, the second upper flexible arms 28 are made into a two-ply structure with respect to the first upper flexible arms 27 by bending at the upper bending portions 22B, and the second lower flexible arms 26 are made into a two-ply structure with respect to the first lower flexible arms 25 by bending at the lower bending portions 22A, but even so, because there is a bending allowance provided at the upper bending portions 22B and the lower bending portions 22A, there is a gap between the first upper flexible arms 27 and the second upper flexible arms 28, so they are capable of undergoing elastic bending displacement independently of each other. Similarly, the first lower flexible arms 25 and the second lower flexible arms 26 are capable of undergoing elastic bending displacement independently of each other. As a result, good contact can be ensured between the flat conductor P and the first upper striking portions 27A, the second upper striking portions 28A, the first lower striking portions 25A, and the second lower striking portions 26A, respectively.

In this embodiment, front end upper edges 24C of the lower arms 21 are located higher than in the previous embodiment, but this means that the arms 34B in the cams 34 of the pressurizing member 30 can be shorter.

Also, the upper arms and lower arms each had two upper flexible arms and two lower flexible arms as in the drawings, but may instead have three or more of each.

DESCRIPTION OF THE REFERENCE CODES

20 terminals
21 lower arm
22 upper arm
23 linking portion
25 first lower flexible arm
25A first lower striking portion
26 second lower flexible arm
26A second lower striking portion
27 first upper flexible arm
27A first upper striking portion
28 second upper flexible arm
28A second upper striking portion
30 pressurizing member

What is claimed is:

1. An electrical connector for a flat conductor, said connector comprising a housing formed with a receptacle into which a connecting portion provided on the front end side of the flat conductor is inserted forward, a plurality of terminals made of sheet metal and arranged on and supported by the housing at a right angle to an upper wall and a bottom wall of the housing, and a pressurizing member that is movably supported by the housing or by a member attached to the housing and that increases the contact pressure between the flat conductor and the terminals, wherein at least some of the plurality of terminals each have a lower arm that is supported by the bottom wall of the housing and is formed with a lower striking portion that strikes the lower face of the flat conductor, and an upper arm that is linked via a linking portion to the lower arm, receives force from the pressurizing member, presses on the upper face of the flat conductor, and is formed with an upper striking portion that increases the contact pressure between the flat conductor and the lower striking portion, the lower arms each have a plurality of integral lower flexible arms including at least a first lower flexible arm and a second lower flexible arm that are elastically displaceable independently of each other, the lower striking portions each have a first lower striking portion formed on the first lower flexible arm and a second lower striking portion that is formed on the second lower flexible arm at a position that is offset in the longitudinal direction with respect to the first lower striking portion, the upper arms each have a plurality of integral upper flexible arms including at least a first upper flexible arm and a second upper flexible arm that are elastically displaceable independently of each other, and the upper striking portions each have a first upper striking portion formed on the first upper flexible arm and a second upper striking portion that is formed on the second upper flexible arm at a position that is offset in the longitudinal direction with respect to the first upper striking portion.

2. The electrical connector for a flat conductor according to claim 1, wherein the lower striking portions are provided at positions where the first lower striking portions are opposite the first upper striking portions in the up and down direction, and the second lower striking portions are opposite the second upper striking portions in the up and down direction.

3. The electrical connector for a flat conductor according to claim 1, wherein the lower flexible arms and/or the upper flexible arms of the terminals are in a two-ply structure obtained by bending a single sheet of metal.

4. The electrical connector for a flat conductor according to claim 2, wherein the lower flexible arms and/or the upper flexible arms of the terminals are in a two-ply structure obtained by bending a single sheet of metal.

* * * * *